US006016918A

United States Patent [19]

Ziberna

[11] Patent Number: 6,016,918

[45] Date of Patent: Jan. 25, 2000

[54] PART CARRIER STRIP

[75] Inventor: Frank Ziberna, Winfield, Ill.

[73] Assignee: Dial Tool Industries, Inc., Addison, Ill.

[21] Appl. No.: 09/135,837

[22] Filed: Aug. 18, 1998

[51] Int. Cl.[7] ..... B65D 85/38

[52] U.S. Cl. ..... 206/714; 174/52.4; 206/716; 206/725

[58] Field of Search ..... 206/713–716, 206/725, 329–331; 174/52.4

[56] References Cited

U.S. PATENT DOCUMENTS

| | | | |
|---|---|---|---|
| 3,523,608 | 8/1970 | Miller . | |
| 3,797,655 | 3/1974 | Boone et al. . | |
| 4,118,859 | 10/1978 | Busler . | |
| 4,195,193 | 3/1980 | Grabbe et al. . | |
| 4,418,815 | 12/1983 | Anderson et al. . | |
| 4,483,441 | 11/1984 | Akizawa et al. | 206/716 |
| 4,583,641 | 4/1986 | Gelzer . | |
| 4,600,971 | 7/1986 | Rose et al. . | |
| 4,611,262 | 9/1986 | Galloway et al. | 206/717 X |
| 4,621,486 | 11/1986 | Slavicek . | |
| 4,631,897 | 12/1986 | Slavicek . | |
| 4,712,675 | 12/1987 | Scholten et al. . | |
| 4,757,895 | 7/1988 | Gelzer . | |
| 4,781,953 | 11/1988 | Ball . | |
| 5,085,362 | 2/1992 | Art et al. . | |
| 5,170,328 | 12/1992 | Kruppa | 174/52.4 X |
| 5,263,241 | 11/1993 | Hart, Jr. et al. . | |
| 5,312,015 | 5/1994 | Gelzer . | |
| 5,361,901 | 11/1994 | Schenz et al. . | |
| 5,472,085 | 12/1995 | Gelzer . | |
| 5,524,765 | 6/1996 | Gutentag . | |
| 5,878,890 | 3/1999 | Kaneko | 206/714 |

FOREIGN PATENT DOCUMENTS

| | | |
|---|---|---|
| 25 51 364 A1 | 5/1977 | Germany . |
| 4-6055 | 1/1992 | Japan . |
| 5-305985 | 11/1993 | Japan . |

*Primary Examiner*—Bryon P. Gehman
*Attorney, Agent, or Firm*—Marshall, O'Toole, Gerstein, Murray & Borun

[57] ABSTRACT

A part carrier strip in combination with a part for insertion therein. A flexible planar part carrier strip includes a plurality of part-receiving apertures define by a plurality of side edges. Each of the aperture side edges includes an inwardly projecting and resiliently deflectable tab. Each part is adapted for securement in a corresponding one of the apertures and includes a closed top side, an open bottom side having a peripheral flange, and a plurality of interconnecting sidewalls. Each sidewall is disposed adjacent a corresponding one of the aperture side edges, and each sidewall further includes an outwardly projecting retaining member spaced upwardly from the peripheral sidewall. The retaining members and the sidewall define therebetween a capture area adapted to receive therewithin an adjacent one of the side edge tabs to thereby retain each part on the strip.

19 Claims, 4 Drawing Sheets

PART CARRIER STRIP

FIELD OF THE INVENTION

The present invention relates to a flexible strip for transporting pre-formed parts to an automated assembly device.

BACKGROUND OF THE INVENTION

Flexible part carrier strips for holding and transporting pre-formed parts are commonly employed in the automated manufacture of electronic and other components. Many electronic components are manufactured using robotic loaders and other automated assembly devices in order to maximize the efficiency of the production line. Automated assembly machines typically have a loading arm which retrieves the part from a pre-designated location and inserts the part in place on a component being assembled on the production line, such as an electronic circuit board. The part is then soldered, welded, or otherwise connected to the circuit board by another automated step further down the assembly line. Such automated assembly devices are commonly used in the construction of electronic circuit boards and other electronic devices.

In order to maintain the efficiency of the production line, the component parts must be presented to the automated loader at a consistent pre-determined location, and at a consistent pre-determined orientation. Any deviations from the desired orientation or location will result in defective assembly of the final product. In order to ensure the proper presentation of the part to the loading device, most automated assembly lines utilize carrier strips, carrier tapes, or carrier trays to deliver a properly oriented part to the pickup point.

On a typical carrier tape or strip, the oriented parts are secured at precise intervals along a flexible continuous strip of plastic. The steps of forming the part and securing the part to the carrier strip is usually performed away from the automated assembly line. The strip holding the parts is then rolled, transported, and fed into a loading machine on the assembly line using a commercially available feeding device. On many component parts, it is necessary to have a plurality of legs or projections extending from the part, which legs or projections are aligned with and received by a plurality of corresponding recesses in the part carrier strip. For example, one type of carrier strip known under the tradename "GPAX" is described in U.S. Pat. Nos. 4,583,641 and 4,757,895. The GPAX structures disclose a carrier tape having a plurality of part receiving recesses and intervening slots punched along the length of the strip. The recesses are adapted to engage the legs, stubs, or leads on the part, and the part is secured to the strip using a plastic bonding tape which overlays the parts.

Another carrier strip structure, known as "debossed tape and reel" consists of a plastic carrier tape with a plurality of recesses or pockets along the length thereof in which the parts are placed. A sealing tape is bonded over the length of the carrier tape in order to retain the parts within their respective pockets. The carrier tape is fed into the robotic loader, which peels away the sealing tape, removes the part, and then discharges both the carrier tape and the sealing tape to waste. The debossed tape and reel structure is best suited for flat parts, and the two-part disposable nature of the tape and reel method is very expensive.

One such component part frequently installed on the finished electrical device is a Radio Frequency shield (RF shield). An RF shield covers a selected electronic component in order to protect that selected component from electrical interference. RF shields, like other discrete elements on the finished component, are likewise loaded and assembled using automated equipment, and hence the RF shield must be adapted for use with a part carrier strip.

Unfortunately, RF shields typically lack electrical leads or other structures which could be used to orient the RF shield and secure the RF shield to the carrier strip. Thus, many RF shields are equipped with a series of sidewall perforations, which perforations are engaged by a plurality of projections or lugs surrounding the part receiving area on the carrier strip. Although the sidewall perforations enhance the ability of the RF shield to be carried on the carrier strip, the sidewall perforations degrade the protective effects of the RF shield, often to an unacceptable degree. RF shields having perforated sidewalls are often unacceptable for use on high frequency applications.

Accordingly, there exists a need for an improved and flexible part carrier strip which is well-suited for securing and transporting RF shields, and for an RF shield for use therewith having no sidewall perforations.

SUMMARY OF THE INVENTION

An improved part carrier strip according to the present invention is readily adaptable to carry parts, such as an RF shield, having non-perforated sidewalls and having no projecting leads, and is well suited for use with automated loading and unloading devices. Moreover, the present part carrier strip is not destroyed during the unloading process, and is thus reusable.

According to one aspect of the invention, a part carriers strip in combination with a part for insertion therein includes a flexible planar strip having a plurality of part-receiving apertures, with each aperture being defined by a plurality of side edges. Each of the aperture side edges includes an inwardly projecting and resiliently deflectable tab. Each part is adapted for securement in a corresponding one of the apertures, and each part includes a closed top side, an open bottom side having a peripheral flange, and a plurality of interconnecting sidewalls. Each sidewall is disposed adjacent a corresponding one of the aperture side edges, and each sidewall further includes an outwardly projecting retaining member spaced upwardly from the peripheral sidewall. The retaining members and the sidewall define therebetween a capture area adapted to receive therewithin an adjacent one of the side edge tabs to thereby retain each part on the strip.

Preferably, each of the tabs includes an inner edge adapted to abut the adjacent part sidewall to thereby laterally position the part within the aperture. Also, each retaining member is preferably integrally formed in its respective sidewall, such as in the shape of a dimple that is stamped or otherwise formed in the sidewall. Each part preferably is formed of a rigid material.

Each of the tabs that are formed in the strip and which surround the part receiving areas include an upper surface positioned to abut an adjacent one of the retaining members and a lower surface positioned to abut the peripheral flange when a part is positioned in the part receiving aperture. One or more of the aperture side edges may includes a pair of tabs, with each of the pair of tabs being positioned to be aligned with a corresponding pair of retaining members on the adjacent part sidewall. Each of the retaining members includes an upper surface adapted to deflect an adjacent one of the retaining tabs in response to upward movement of the part into the part receiving area, which thereby facilitates insertion of the part into the part receiving aperture for retention therein.

In accordance with another aspect of the invention, a part carrier system for presenting pre-formed parts to an automated assembly machine comprises a flexible member capable of being flattened into a planar strip and having a plurality of part receiving apertures, and a plurality of parts adapted for securement in a corresponding one of the part receiving apertures. Each of the part receiving apertures on the planar strip is bounded by a plurality of side edges, and each of the side edges includes a retaining member. Each retaining member is resiliently deflectable, for example, in response to the insertion or removal of a part into the part receiving aperture. Each part includes a closed top side, an open bottom side having a peripheral flange, and a plurality of interconnecting sidewalls. Each sidewall is adapted to be disposed adjacent a corresponding one of the aperture side edges. Each sidewall also includes an outwardly projecting member or dimple formed integrally in the part sidewall and being spaced upwardly from the peripheral flange. A portion of the dimple and the peripheral flange define therebetween a capture area adapted to receive therewithin an adjacent one of the retaining members, thus retaining each part on the strip.

In accordance with yet another aspect of the invention, a part carrier system comprises a flexible planar strip having a plurality of part-receiving apertures, with each aperture being defined by a plurality of side edges. A plurality of parts are adapted for placement in a corresponding one of the apertures, with each part including a closed top side, an open bottom side, and a plurality of interconnecting sidewalls. Each part sidewall is disposed adjacent a corresponding one of the aperture side edges. Part retaining means are provided for retaining each part in its corresponding aperture. The part retaining means is defined by cooperating outwardly projecting portions of the part and inwardly projecting portions of the aperture side edges, to thereby retain each of the parts in its corresponding part receiving aperture.

These and other advantages and features of the invention will become readily apparent to those skilled in the art upon a reading of the following description.

BRIEF DESCRIPTION OF THE DRAWING

In the course of the following detailed description, reference will be made to the attached drawings wherein like reference numerals identify like parts and wherein.

DETAILED DESCRIPTION OF THE PREFERRED EMBODIMENT

The embodiment described herein is not intended to limit the scope of the invention to the precise form disclosed. The embodiment has been chosen and described in order to explain the principles of the invention and its practical use in order to enable others skilled in the art to follow its teachings.

Figure 1:
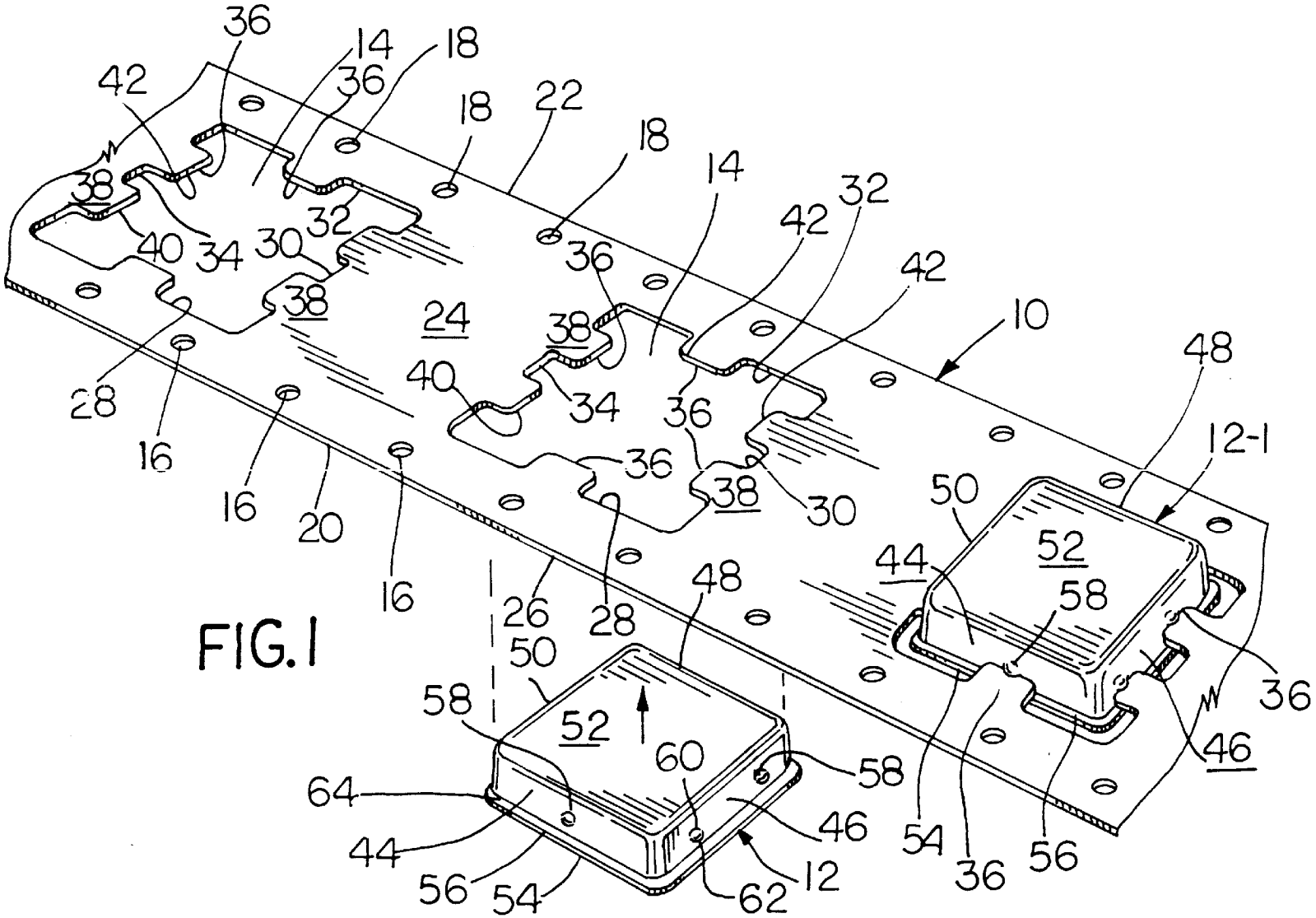
FIG. 1 is a perspective view of a part carrier strip and part for insertion therein according to the present invention and showing one part secured by the strip and another part ready for insertion into the strip.

Referring now to FIG. 1 of the drawings, a part carrier strip 10 and a part 12 for insertion therein are shown, both of which are constructed in accordance with the teachings of the present invention. The part 12 is typically formed from a continuous strip of metal (not shown) into a plurality of discrete parts 12 by stamping with a die assembly (not shown) in a manner well known to those of skill in the art. The die assembly may also concurrently secure the part or parts 12 to the parts carrier strip 10 in a manner discussed more fully below.

Preferably, the carrier strip 10 is fabricated of polypropylene or any other suitable plastic or other material and is two inches wide and 0.020 inches thick. Other dimensions are possible, depending on the requirements of the particular application. The carrier strip 10 may be-fed by any suitable means, and, in the preferred embodiment is fed into the die by an air-operated feeding device (not shown) which may comprise, for example, a model B4 feeder manufactured by Rapid Air Corporation of Rockford, Ill.

Figure 2:
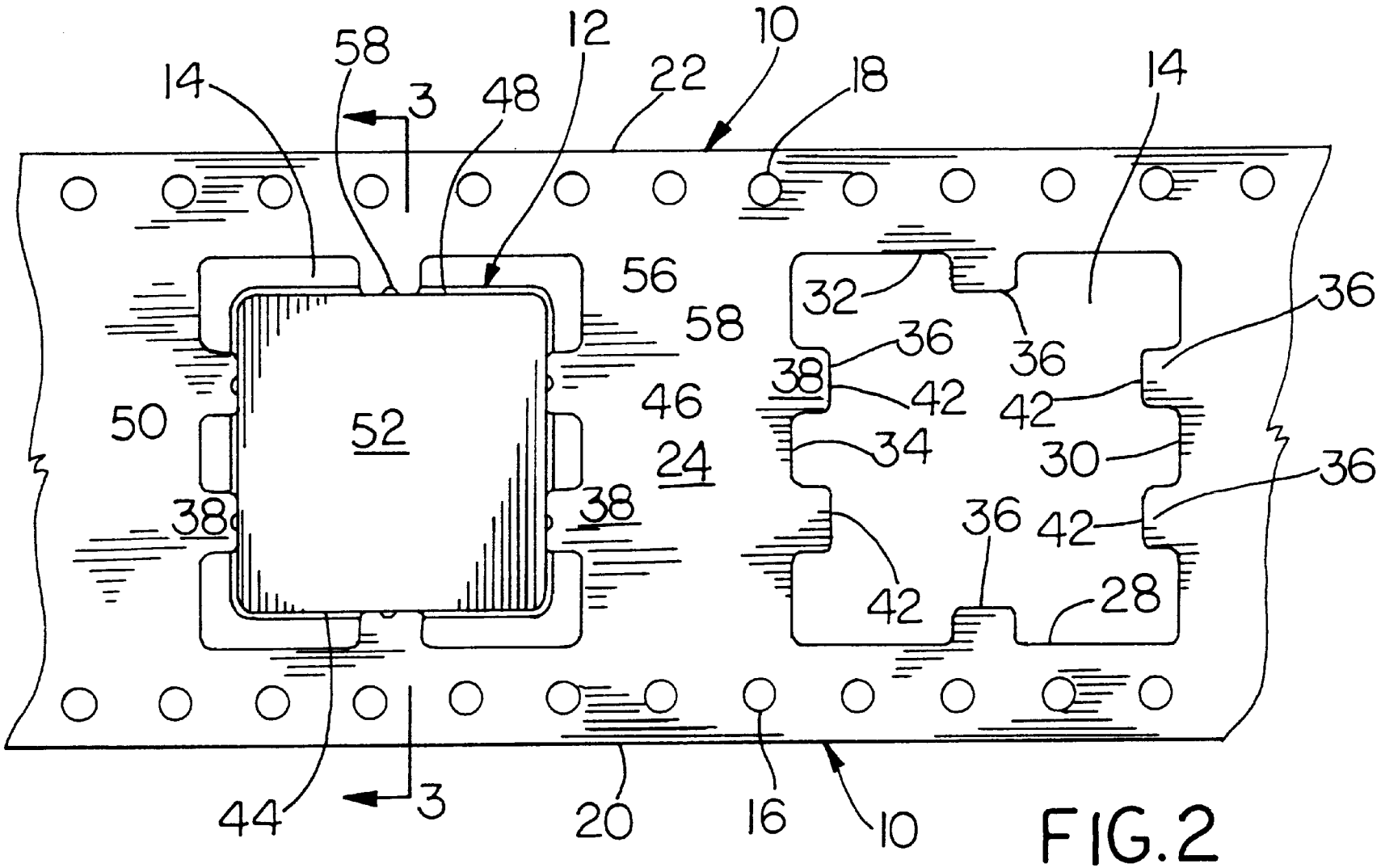
FIG. 2 is a fragmentary plan view of the part carrier strip having a part secured therein.

As seen in FIG. 2, the carrier strip 10 is generally planar and includes a plurality of part-receiving apertures 14. First and second series of marginal positioning holes 16, 18 are located on either side of the apertures 14 adjacent the edges 20, 22, respectively, of the strip 10. Preferably, each set of positioning holes 16, 18 are regularly spaced, and are precisely located with respect to the apertures 14 to permit accurate placement of the carrier strip 10 during insertion of the part 12 therein. For purposes of reference with respect to the orientation of the part 12, the strip 10 includes a top side 24 and a bottom side 26.

Each aperture 14 includes four side edges 28, 30, 32 and 34, which generally define the bounds of the apertures 14. Each side edge 28, 30, 32, 34 includes at least one retaining member or tab 36. Each retaining tab 36 includes an upper surface 38 and a lower surface 40 which are generally coplanar with the top and bottom sides 24, 26, respectively, of the strip 10. Each retaining tab 36 projects in a generally inward direction, i.e., inwardly from its adjacent sidewall and generally into the aperture 14, and terminates in an inner edge 42. Each retaining tab 36 is also deflectable upwardly or downwardly as will be discussed in further detail below.

Referring now to FIGS. 1 and 3–6, the part 12 includes a plurality of sidewalls 44, 46, 48 and 50 joined by an interconnecting planar top side 52. A generally open bottom side 54 is disposed opposite the top side 52, and is surrounded by a peripheral flange 56. The top side 52 and the sidewalls 44, 46, 48 and 50 generally surround a cavity 55, which cavity 55 may be adapted to receive therein an electrical component (not shown), such as an electrical component that must be shielded from RF. The part 12 is preferably constructed of a relatively rigid material such as steel, although other suitable materials capable of functioning as an RF shield may be employed. The sidewalls 44, 46, 48 and 50 as well as the planar top side 52 are preferably substantially or completely free of perforations. Each of the sidewalls 44, 46, 48 and 50 includes at least one projection or dimple 58. Preferably, each of the dimples 58 is integrally formed, molded or stamped into its respective sidewall. Each dimple includes an upper portion 60 and a lower portion 62. Alternatively, the dimples 58 could be a separate member that has been glued, bonded, or otherwise secured to the appropriate location on each of the sidewalls 44, 46, 48 and 50. Further, it is conceivable that the dimples 58 could take the form of a unified structure surrounding the periphery of the part 12, such as in the shape of an intermediate peripheral flange (not shown). As can be seen to advantage in FIGS. 3 and 4, the lower portion 62 of each dimple cooperates with an upper face 64 of the peripheral flange 56 to define a gap 66. The gap 66 is sized to receive the inner edge 42 of an adjacent one of the retaining tabs 36.

Figure 3:
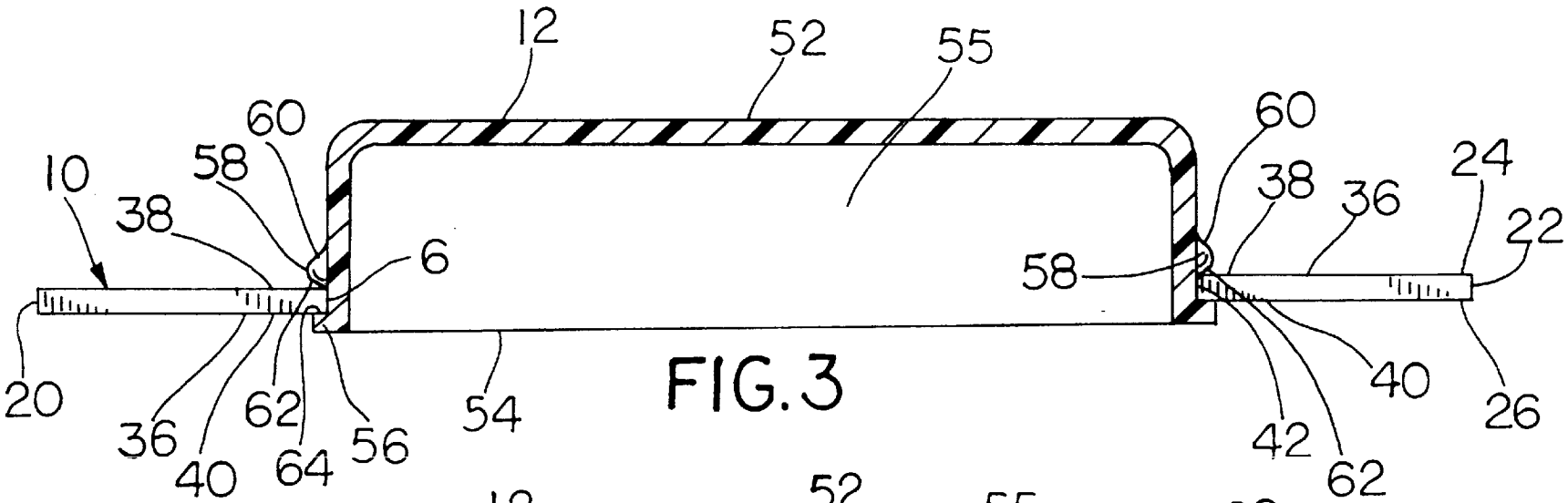
FIG. 3 is an enlarged fragmentary cross-sectional view taken along lines 3—3 of FIG. 2.
Figure 4:
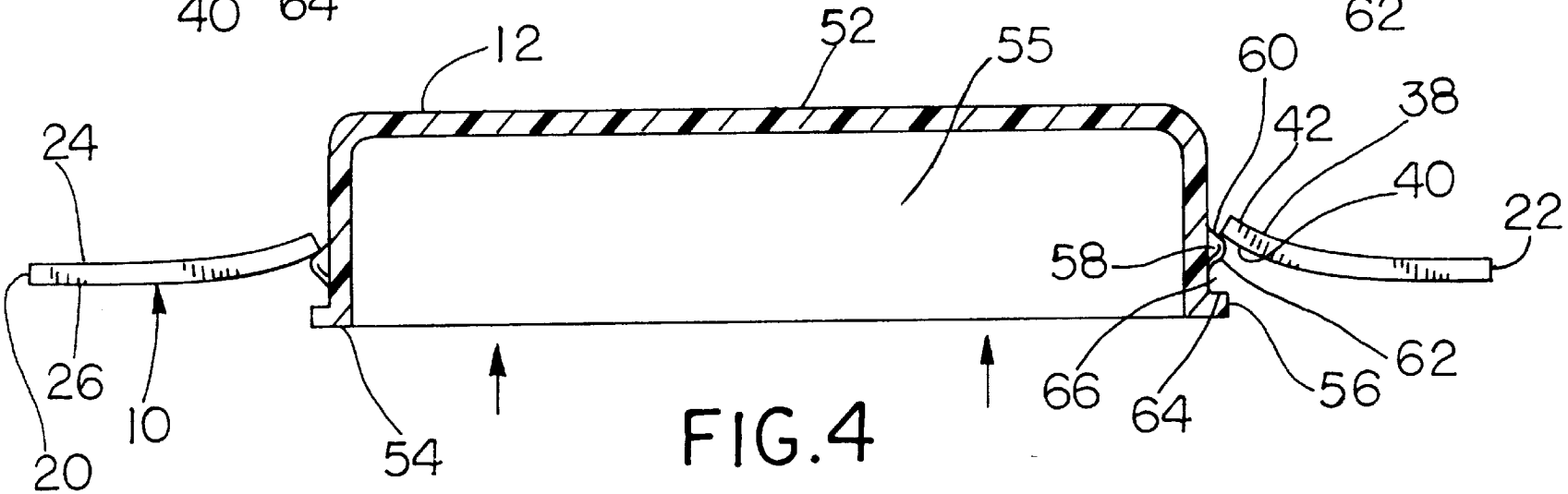
FIG. 4 is an enlarged fragmentary cross-sectional view similar to FIG. 3 and illustrating the preferred method of inserting the part into the strip.
Figure 5:
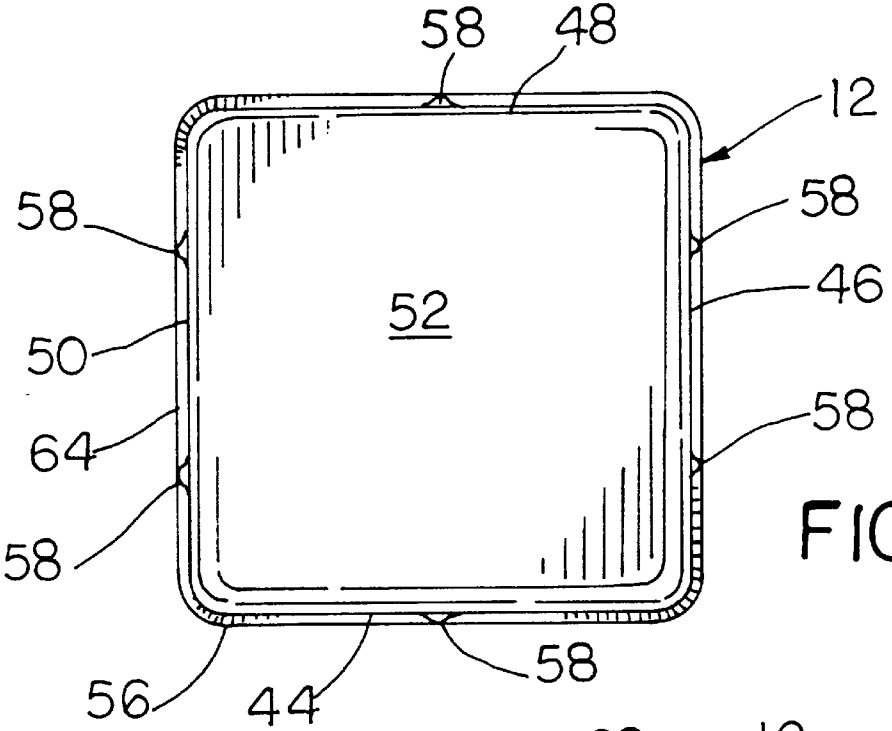
FIG. 5 is an enlarged top plan view of the part.
Figure 6:
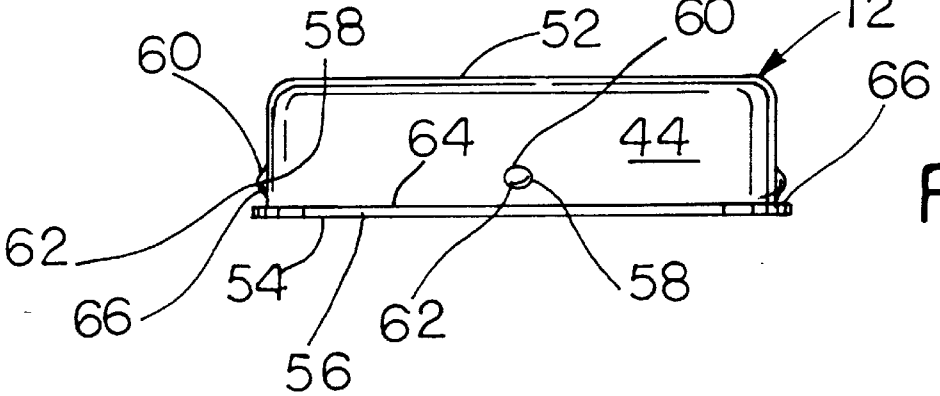
FIG. 6 is an enlarged side elevational view of the part.

As discussed above, the inner edge 42 of the retaining tab 36 is deflectable in order to permit the insertion of the part 12 into the aperture 14 of the carrier strip 10, or to permit the removal of the part 12 from the carrier strip 10. For example, as shown in FIG. 4, when the part 12 is moved in a generally upward direction into the aperture 14, the top surface 60 of the dimple 58 abuts or cams against the bottom surface 40 of the retaining tab 36 adjacent the inner edge 42, which forces the inner edge 42 of the retaining tab 36 to deflect in an upward direction. Alternatively, it is conceivable that the tab 36 could be arranged so as to deflect in a downward direction. After deflection, the retaining tab 36 will return to its original, generally inwardly facing and horizontal position with the inner edge 42 disposed within the gap 66. As shown in FIG. 3, when the inner edge 42 of the retaining tab 36 is disposed within the gap 66, the upper surface 38 of the tab 36 abuts the lower surface 62 of the dimple 58, while the lower surface 40 of the tab 36 abuts the upper face 64 of the peripheral flange 56, thereby preventing upward or downward movement of the part 12 relative to the carrier strip 10. Further, the inner edges 42 of opposing retaining tabs 36 (i.e., tabs 36 on opposite sides of the aperture 14) retain the part 12 against any lateral movement relative to the aperture 14.

In operation, a die assembly (not shown) will typically include a series of forming stations (not shown) which sequentially stamp a metal strip into a series of parts 12, two of which are shown in FIG. 1 as 12 and 12-1. The parts 12 and 12-1 are stamped from a metal strip in a manner similar to that which is discussed more fully in co-pending patent application Ser. No. 08/692,009. The die assembly also inserts the part 12 into the aperture 14 of the carrier strip 10 in a manner that will deflect the retaining tabs 36 substantially as shown in FIG. 4, so as to permit the insertion of the part 12 into the aperture 14. Preferably, the retaining tabs 36 are deflected upwardly away from the top side 24 of the carrier strip 10 by the deflecting action of the top portion 60 of the dimple 58. Upon upward deflection of each of the retaining tabs 36 that surround the periphery of the aperture 14, the part 12 is moveable upwardly as shown in FIG. 4 until the retaining tabs clear the dimple 58, at which point the retaining tabs 36 deflect back to their original, inwardly projecting position with the inner edges 42 disposed within the gap 66 as shown in FIG. 3. Accordingly, the part 12 is secured against vertical movement by the retaining tabs 36 in cooperation with the dimples 58 and the peripheral flange 56, and is further secured against any lateral movement relative to the surface of the carrier strip 10 by the cooperating inner edges 42 of each of the retaining tabs 36 surrounding the aperture 14.

As should be evident from the foregoing, the carrier strip 10 will eventually be loaded with a series of parts 12, 12-1, etc., in the apertures 12. Thereafter, the carrier strip 10 can be rolled up onto reels and delivered to another location whereupon the parts 12, 12-1, etc., can be removed from the carrier strip. Further, the parts are consistently presented in proper orientation to the assembly apparatus (not shown). Thereafter, if desired, the carrier strip can be reused, i.e., loaded with additional parts and again delivered to the assembly location. This reusability is a highly important feature of the present invention and can significantly reduce manufacturing costs. This feature results from the ability of the retaining members 36 to deflect and return to their original shape without permanent deformation.

In addition to the foregoing, no secondary labor is required to load parts onto the carrier strip or otherwise perform a finishing operation thereon. Labor costs are low and packaging costs are held to a minimum since no adhesive, cover strips, etc. . . . are used.

As noted above, dimensions of the strip 10 may vary according to the requirements of the particular application contemplated. Also, the carrier strip 10 need not be fabricated of plastic, but instead could be made of any material which is sufficiently resilient to allow the retaining tabs 36 to deflect when a part is inserted into the apertures 14, and so that the tabs 36 subsequently return to an undeflected position.

Also as noted above, the dimensions of the strip 10 and the sizes and shapes of the apertures as well as the parts 12 can be varied as needed and still obtain the unique benefits afforded by the present invention.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A combination, comprising:

a flexible planar strip having a plurality of part-receiving apertures, each aperture being define by a plurality of side edges, each of the side edges including an inwardly projecting tab, each tab being resiliently deflectable; and a plurality of parts, each part being adapted for securement in a corresponding one of the apertures, each part including a closed top side, an open bottom side having a peripheral flange, and a plurality of interconnecting sidewalls, each sidewall being disposed adjacent a corresponding one of the aperture side edges, each sidewall further including an outwardly projecting retaining member spaced upwardly from the peripheral flange, the retaining members and the sidewall defining therebetween a capture area adapted to receive therewithin an adjacent one of the tabs to thereby retain each part on the strip.

2. The combination of claim 1, wherein each of the tabs includes an inner edge adapted to abut the adjacent part sidewall to thereby laterally position each part within its corresponding aperture.

3. The combination of claim 1, wherein each retaining member is integrally formed in its respective sidewall.

4. The combination of claim 1, wherein each retaining member comprises a dimple.

5. The combination of claim 1, wherein each of the parts is formed of a rigid material, and further wherein each of the retaining members comprises a dimple integrally formed in the sidewall.

6. The combination of claim 1, wherein each tab includes an upper surface abutting an adjacent one of the retaining members and a lower surface abutting an adjacent one the peripheral flanges.

7. The combination of claim 1, wherein each aperture side edge includes a pair of tabs and further wherein each part sidewall includes a pair of retaining members disposed adjacent the pair of tabs.

8. The combination of claim 1, wherein each retaining member includes an upper surface adapted to deflect an adjacent one of the tabs in response to upward movement of a part into its corresponding aperture.

9. A part carrier system for presenting pre-formed parts to an automated assembly machine, the system comprising:

a flexible member capable of being flattened into a planar strip and having a plurality of part receiving apertures, each of the part receiving apertures being bounded by a plurality of side edges, each of the side edges including a resilient retaining member adapted to deflect in response to placement of a part in the aperture; and a plurality of parts, each part being adapted for securement in a corresponding one of the apertures, each part including a closed top side, an open bottom side having a peripheral flange, and a plurality of interconnecting sidewalls, each sidewall being disposed adjacent a corresponding one of the aperture side edges and including an outwardly projecting dimple formed integrally in the part sidewall, the dimple being spaced upwardly from the peripheral flange, a portion of the dimple and the peripheral flange defining therebetween a capture area adapted to receive an adjacent one of the retaining members.

10. The part carrier system of claim 9, wherein each of the retaining members is upwardly deflectable in response to upward placement of a part into its corresponding aperture.

11. The part carrier system of claim 9, wherein each of the retaining members projects inwardly into one of the part receiving apertures.

12. The part carrier system of claim 9, wherein each part is an RF shield.

13. The part carrier system of claim 12, wherein the sidewalls are solid.

14. The part carrier system of claim 9, wherein each of the retaining members includes an inner edge adapted to abut the adjacent part sidewall to thereby laterally position the ant part within its corresponding part receiving aperture.

15. The part carrier system of claim 9, wherein each dimple is integrally formed in its respective sidewall.

16. The part carrier system of claim 9, wherein each retaining member includes an upper surface abutting an adjacent one of the sidewall dimples and a lower surface abutting an adjacent one of the peripheral flanges.

17. The part carrier system of claim 9, wherein each aperture side edge includes a pair of retaining members and further wherein each part sidewall includes a pair of dimples.

18. The part carrier system of claim 9, wherein each dimple includes an upper surface adapted to deflect an adjacent one of the retaining members in response to upward movement of a part into its corresponding aperture.

19. A combination, comprising:

a flexible planar strip having a plurality of part-receiving apertures, each aperture being define by a plurality of side edges;

a plurality of parts, each of the parts being adapted for placement in a corresponding one of the apertures, each part including a closed top side, an open bottom side, and a plurality of interconnecting sidewalls, each part sidewall being disposed adjacent a corresponding one of the aperture side edges; and part retaining means for retaining each part in its corresponding aperture, the part retaining means being defined by cooperating outwardly projecting portions of each part and inwardly projecting portions of its corresponding aperture side edges.

* * * * *